US008011897B2

(12) United States Patent
Raleigh et al.

(10) Patent No.: US 8,011,897 B2
(45) Date of Patent: Sep. 6, 2011

(54) CAM DRIVEN PISTON COMPRESSOR

(75) Inventors: Timothy T. Raleigh, Long Grove, IA (US); Sammy K Mickelson, Bettendort, IA (US)

(73) Assignee: Carleton Life Support Systems Inc., Davenport, IA (US)

( * ) Notice: Subject to any disclaimer, the term of this patent is extended or adjusted under 35 U.S.C. 154(b) by 410 days.

(21) Appl. No.: 11/997,970

(22) PCT Filed: Aug. 4, 2006

(86) PCT No.: PCT/US2006/030739
§ 371 (c)(1),
(2), (4) Date: Feb. 5, 2008

(87) PCT Pub. No.: WO2007/019452
PCT Pub. Date: Feb. 15, 2007

(65) Prior Publication Data

US 2008/0219861 A1 Sep. 11, 2008

(51) Int. Cl.
*F04B 1/00* (2006.01)
*F04B 27/00* (2006.01)

(52) U.S. Cl. ..... 417/271; 417/415

(58) Field of Classification Search ..... 417/269, 417/271, 454, 415; 74/567
See application file for complete search history.

(56) References Cited

U.S. PATENT DOCUMENTS

| | | | | |
|---|---|---|---|---|
| 1,229,009 | A | 6/1917 | Allison | |
| 2,198,552 | A | 4/1940 | Rieger | |
| 2,444,159 | A | 6/1947 | Godfriaux | |
| 3,556,690 | A * | 1/1971 | Scheffer | 417/471 |
| 3,666,382 | A * | 5/1972 | Rasmussen | 417/533 |
| 3,792,939 | A * | 2/1974 | Zalis | 417/539 |
| 3,830,264 | A | 8/1974 | Billet et al. | |
| 4,372,257 | A * | 2/1983 | Hofbauer et al. | 123/68 |
| 4,658,798 | A | 4/1987 | Yogo et al. | |
| 4,712,518 | A | 12/1987 | Johnson | |
| 4,752,190 | A * | 6/1988 | Fry | 417/238 |
| 5,078,580 | A * | 1/1992 | Miller et al. | 417/265 |
| 5,197,438 | A * | 3/1993 | Kumano et al. | 123/506 |
| 6,328,536 | B1 | 12/2001 | Zebuhr | |
| 2005/0120984 | A1 | 6/2005 | Kuhn | |

FOREIGN PATENT DOCUMENTS

| | | |
|---|---|---|
| JP | 2001088094 | 4/2001 |
| WO | 2005033506 | 4/2005 |
| WO | 2007019452 A2 | 2/2007 |

* cited by examiner

*Primary Examiner* — Devon C Kramer
*Assistant Examiner* — Peter J Bertheaud
(74) *Attorney, Agent, or Firm* — Woods Oviatt Gilman LLP

(57) ABSTRACT

A cam driven piston compressor includes one or more cams powered by a motor, the cams being adapted to rotate through 360 degrees, and one or more cam followers, each of which is in contact with one of the cams. The compressor also includes one or more pistons wherein each of the pistons is attached to one of the cam followers, one or more cylinders wherein each of the cylinders encloses one of the pistons, and a compressor head in contact with the cylinders.

7 Claims, 8 Drawing Sheets

CAM DRIVEN PISTON COMPRESSOR

TECHNICAL FIELD

The present invention relates to compressors and, more particularly, to electrically driven axial compressors.

BACKGROUND OF THE INVENTION

Electrically driven compressors must convert rotary motion from a motor into linear motion to actuate a piston or a series of pistons to generate compressed gas. Most compressors accomplish this task by means of a crankshaft and connecting rod assembly, similar to that found in internal combustion engines. Some advantages to this design are the proven reliability and the high operating efficiency. One major disadvantage is the space required by the connecting rod throughout the complete cycle. This disadvantage becomes particularly evident in multistage compressors used for compressing gas to high pressures, typically greater than 1000 psig. Often, the pistons and cylinders used in the higher stages of these compressors are not large enough to accommodate the connecting rod and the dynamic space it occupies. As a result, many designs limit the piston travel to under 0.5 inches, and use stepped pistons in the higher pressure stages. These actions reduce the compressor efficiency and add components to the assembly.

Other designs for compressors utilize nutating heads to convert rotary motion into linear motion. In these designs, the piston travel is parallel to the axis of rotation. Automotive air conditioning compressors commonly use this type of compressor. An advantage of this style compressor is the low amount of package space required by the compressor. In addition, the connecting rods, if any are used at all, articulate less than those used with crankshafts. This allows more travel in small diameter pistons than with crankshaft designs. One disadvantage to this style of compressor is the piston reciprocation relies mostly on sliding action than rolling action. This increases the amount of friction in the system, and lowers overall compressor efficiency.

It is a principal object of the present invention to combine the rolling action from crankshaft driven compressors with the high piston travel found in nutating head compressors.

SUMMARY OF THE INVENTION

Briefly described, a cam driven piston compressor of the present invention includes one or more cams powered by a motor, the cams being adapted to rotate through 360 degrees, and one or more cam followers, each of which is in contact with one of the cams. The compressor also includes one or more pistons wherein each of the pistons is attached to one of the cam followers, one or more cylinders wherein each of the cylinders encloses one of the pistons, and a compressor head in contact with the cylinders.

BRIEF DESCRIPTION OF THE DRAWINGS

The above-mentioned and other features and advantages of this invention, and the manner of attaining them, will become appreciated and be more readily understood by reference to the following detailed description in conjunction with the accompanying drawings, wherein.

DESCRIPTION OF THE PREFERRED EMBODIMENT

Figure 1:
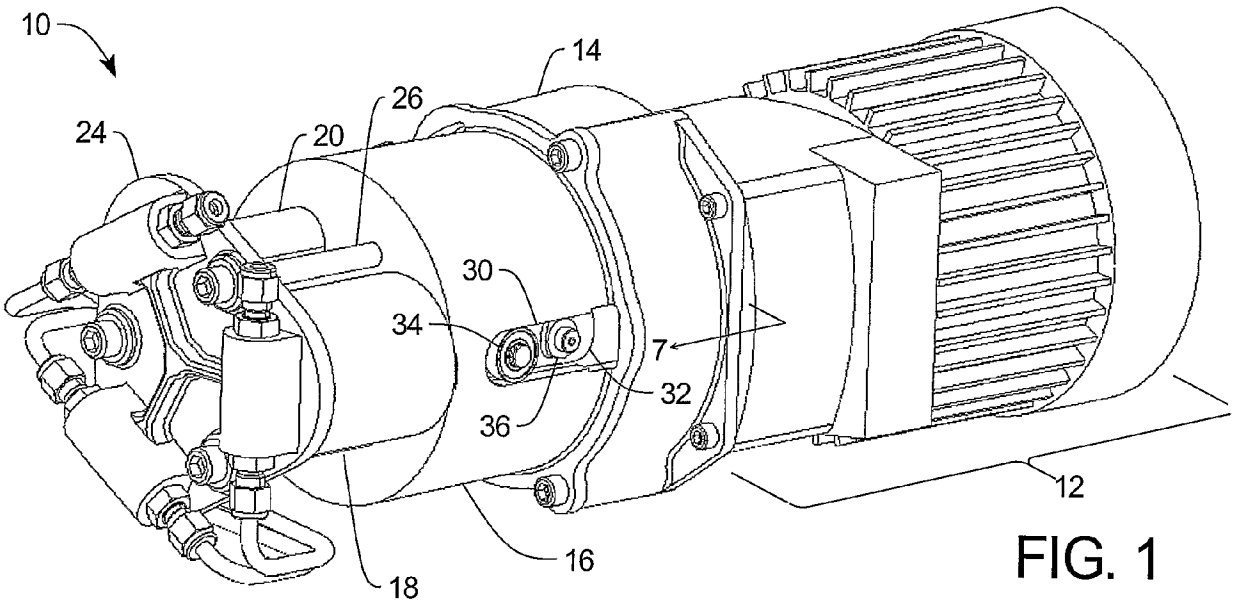
FIG. 1 is a perspective view of a cam driven piston compressor according one embodiment of the present invention.

Referring to FIG. 1, a cam driven piston compressor 10 according to the present invention includes an electric motor and gearbox 12, a lower housing 14, an upper housing 16, three cylinders 18, 20, and 22 (shown in FIG. 2), a compressor head 24, and three head bolts 26. Also shown in FIG. 1 is a machined guide slot 30 formed in the upper housing 16 through which can be seen a cam follower 32. Attached to the cam follower 32 is a cam follower outer guide bearing 34 and a shoulder screw 36.

Figure 2:
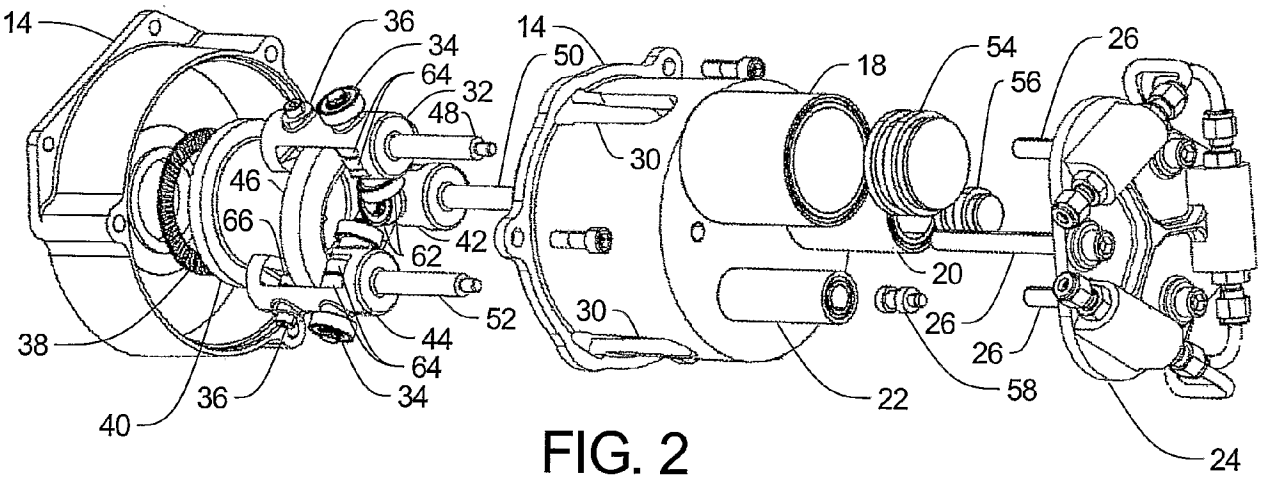
FIG. 2 is an exploded view of a portion of FIG. 1.

FIG. 2 is an exploded view of a portion of the axial cam compressor 10. Shown in FIG. 2 is the lower housing 14, a thrust bearing 38, an axial cam 40, and three cam followers 32, 42, and 44 which straddle an upper lip portion 46 of the cam 40. Each of the cam followers 32, 42, and 44 have piston rods 48, 50, and 52, respectively, which connect to pistons 54, 56, and 58, respectively, which, in turn, fit inside piston cylinders 18, 20, and 22, respectively, which, in turn, are held tightly to the compressor head 24 by the head bolts 26. Each of the cam followers 32, 42, and 44 hold 5 bearings, the outer bearing 34, an inner guide bearing 62, two upper cam follower cam bearings 64 that are in contact with the upper surface of the lip 46 of the cam 40, and a lower cam follower cam bearing 66 that is in contact with the lower surface of the lip 46 of the cam 40.

Figure 3:
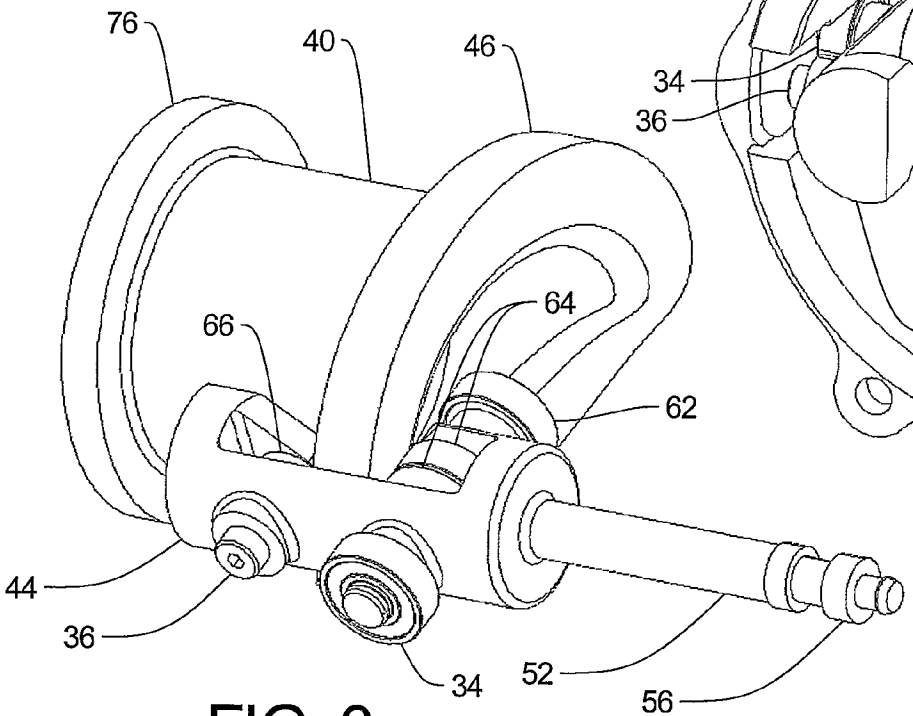
FIG. 3 is a perspective view of the axial cam and one of the cam followers shown in FIG. 2.

FIG. 3 is a perspective view of the cam 40, the cam follower 44, and the piston 56.

Figure 4:
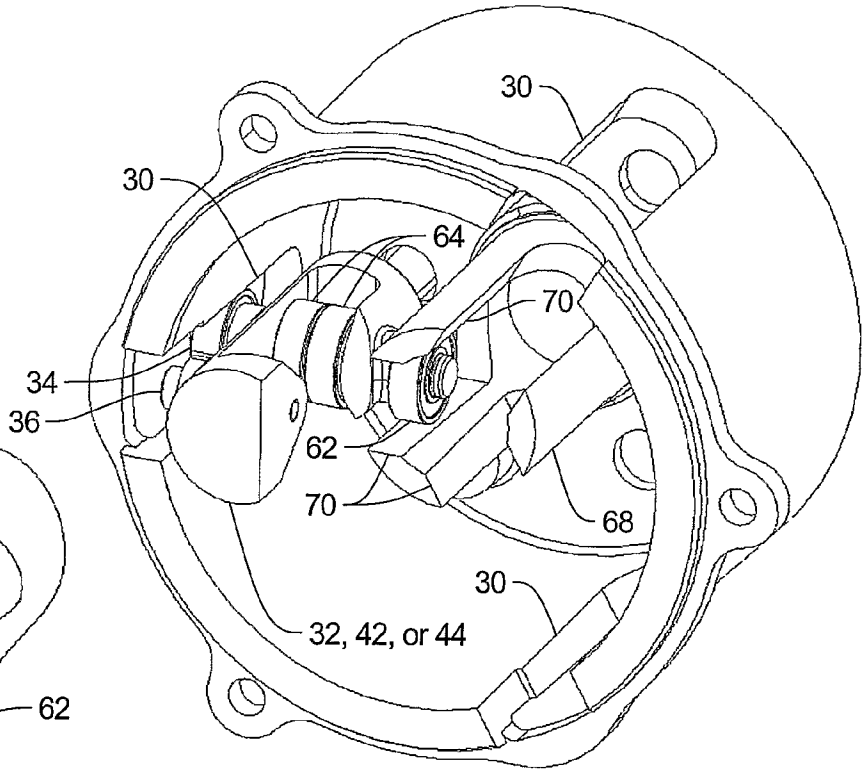
FIG. 4 is a perspective view of the inside of the upper housing with a portion of one of the cam followers shown in FIG. 2.

FIG. 4 is a perspective view of the inside of the upper housing 16 with one of the cam followers 32, 42, or 44 in position. The upper housing 16 includes a centrally positioned inner pipe section 68 having three machined grooves or guide slots 70 formed therein. The inner guide bearing 62 of the cam followers 32, 42, and 44 travel in the grooves 70.

In operation the axial cam 40 converts rotary motion from the electric motor and gearbox 12 into linear motion used to drive the three pistons 54, 56, and 58. As the cam 40 rotates, cam followers 32, 42, and 44 are forced into reciprocal motion by means of bearings 64 and 66 that are attached to the cam followers and ride against the upper surface and lower surface, respectively, of the lip 46 of the cam 40. The cam followers 32, 42, and 44 are restrained to only move linearly by means of the inner and outer guide bearings 62 and 34 that ride in the guide slots 70 and 30, respectively, machined into the upper housing 16. Since the cam follower motion is purely linear, even small diameter pistons can be actuated over a large distance without risk of the cam follower contacting the cylinder wall. Although gas pressure from the small amount of gas that isn't pushed out of the cylinder will be used to start the retraction of the piston, it is the incoming gas pressure, when present, that is the principal retracting force. For the first stage (piston 54 and cylinder 18) this is gas pressure coming into the compressor, but for the latter stages (piston 56 and cylinder 20, piston 58 and cylinder 22), it is the pressurized gas from the previous stage (e.g. as stage 1 completes its compression cycle, the gas flowing out of stage 1 forces the stage 2 piston to fully retract). This effect requires proper cam timing to work efficiently. In case of insufficient pressure entering stage 1, the compressors 10 and 100 shown in FIGS. 1 and 8, respectively, include a means for assisting the first stage piston retraction. With respect to the compressor 10 the cam followers 32, 42, and 44 have the lower cam follower cam bearings 66 on the lower side of the lip 46 of the cam 40 to ensure that the piston retracts properly.

Figure 6:
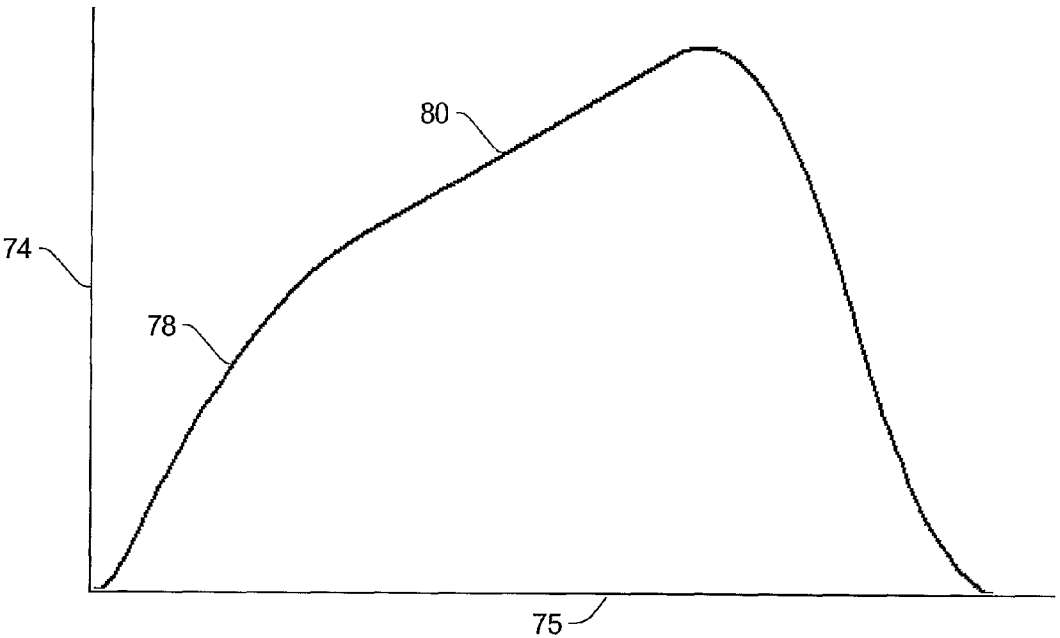
FIG. 6 is a graphical plot of the curve of the height of the upper surface of the cam shown in FIG. 2.
Figure 5:
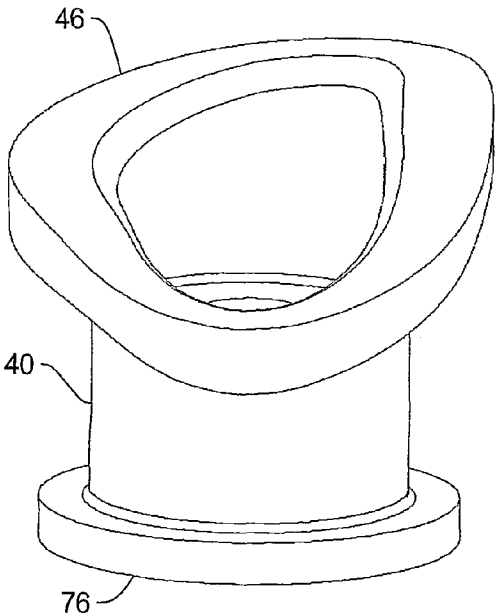
FIG. 5 is a perspective view of the cam shown in FIG. 2.

FIG. 5 is a perspective view of the cam 40 and FIG. 6 is a plot of the variation in height 74 of the upper surface 72 of the lip 42 with respect to the perimeter 76 of the base 76 of the cam 40. The plot has an initial upward sloped region 78 followed by a shallower upward sloped region 80, which, in turn is followed by a downward sloped region 82. When the compression of the gas in a cylinder begins, the torque required to be provided by the motor is minimal and then increases as the piston travels further into the cylinder. Thus, the initial slope in region 78 is greater than the slope in region 80 to place a more constant torque requirement on the motor than if regions 78 and 80 had the same slope.

Figure 7:
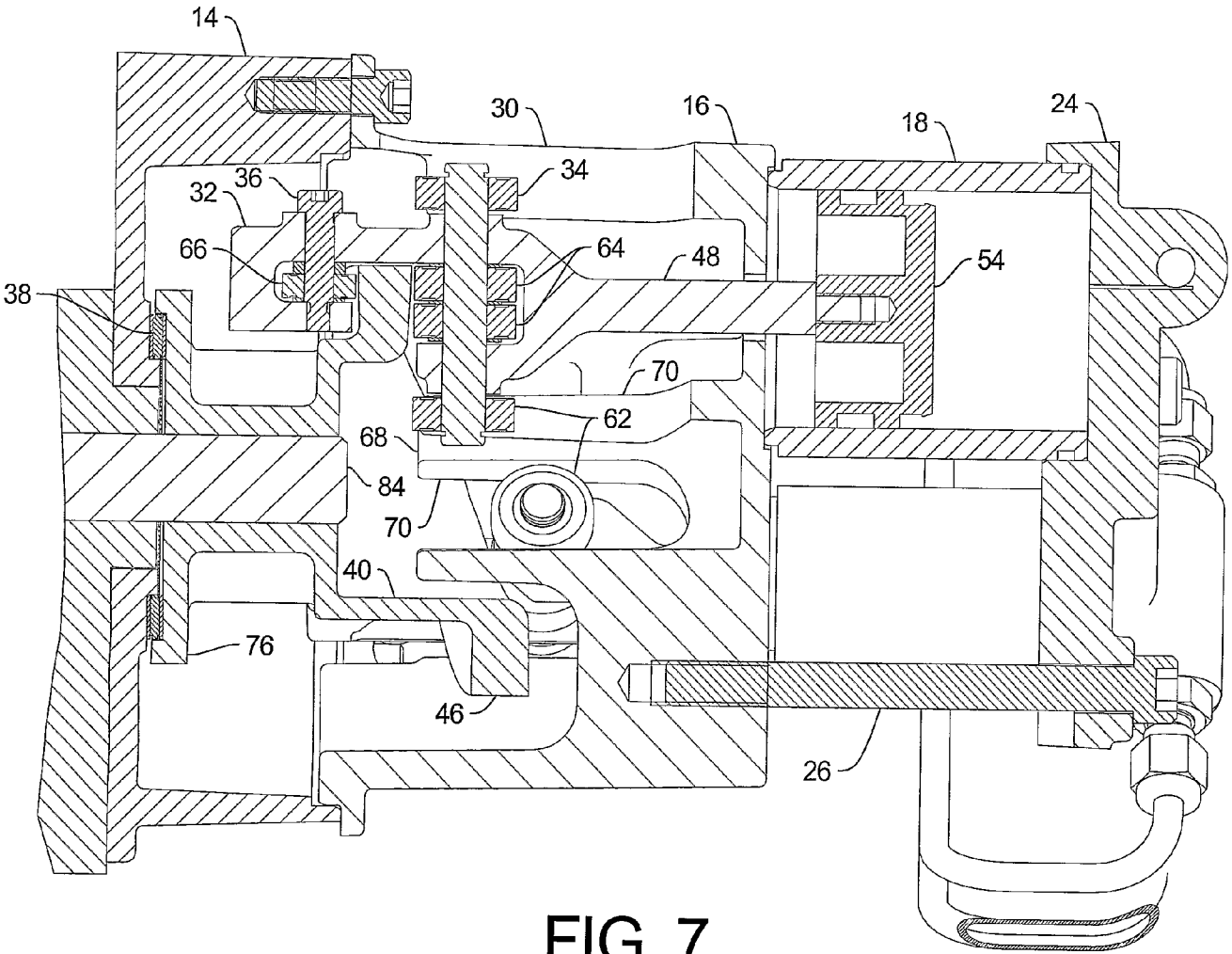
FIG. 7 is a cross section of a portion of FIG. 1.

FIG. 7 is a cross section of the lower housing 14, the upper housing 16, the cylinder 18 and the compressor head 24. Also shown is a cross section of the cam 40, the cam follower 32, a drive shaft 84 from the motor and gearbox 12.

Figure 8:
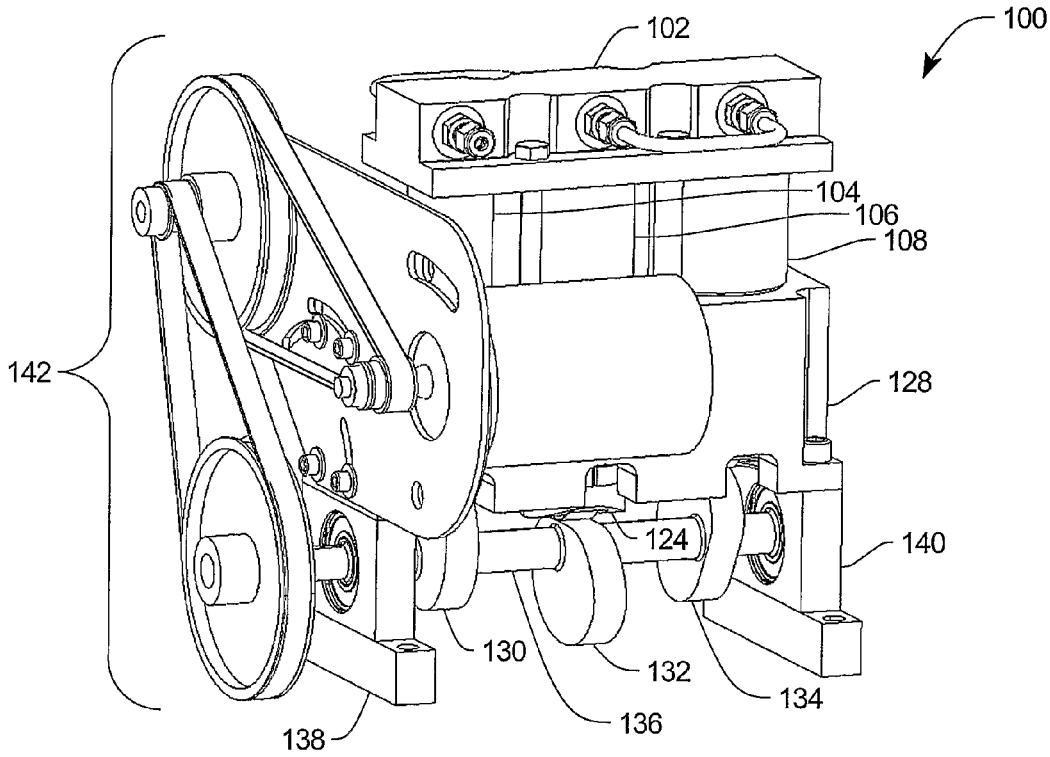
FIG. 8 is a perspective view of a cam driven piston compressor according to a second embodiment of the present invention.
Figure 9:
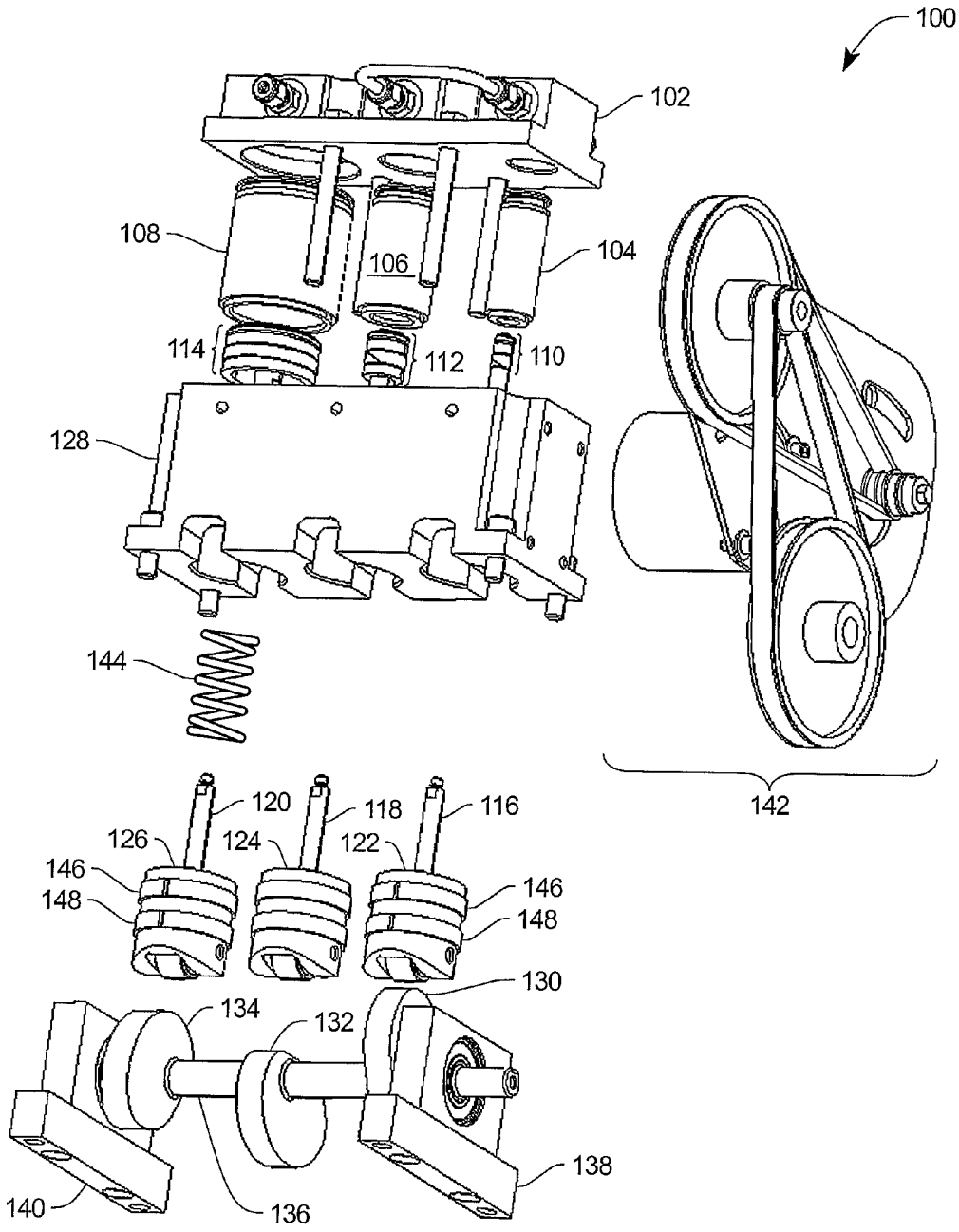
FIG. 9 is an exploded view of the cam driven piston compressor shown in FIG. 8.

FIG. 8 is a perspective view of a cam driven piston compressor 100 according to a second embodiment of the present invention and FIG. 9 is an exploded view of the cam driven piston compressor 100 shown in FIG. 8. The cam driven piston compressor includes a compressor head assembly 102 into which are inserted three cylinders, a smaller diameter cylinder 104, a mid sized diameter cylinder 106, and a larger diameter cylinder 108. The three cylinders 104, 106 and 108 hold pistons 110, 112, and 114, respectively. The pistons 110, 112, and 114 are attached to three connecting rods 116, 118, and 120, respectively, which are each part of three cam followers 122, 124, and 126, respectively. The cam followers 122-126 are located inside three bore holes in a compressor housing 128. During operation of the compressor 100 the cam followers 122, 124, and 126 are pushed up by three cams 130, 132, and 134 which are part of a cam shaft 136 which, in turn, is supported by two bearing blocks 138 and 140. The cam shaft 136 is driven by a motor and belt reduction assembly 142. A coil spring 144, placed around the connecting rod 120, presses the cam follower 126 against the cam 134 in order that the cam follower 126 and the piston 114 follow the profile of the cam 134. The other cam followers 122 and 124 are pressed against the cams 130 and 132 by the gas pressure against the pistons 110 and 112 as described above. In the embodiment shown in FIG. 9, the gas connections to the compressor head assembly are arranged such that the gas pressure is incrementally increased by each of the pistons 110-114. In an alternative embodiment, in which the gas flow through each of the three cylinders 108-112 are separate from each other, springs such as spring 142 may be used with all three cam followers 122-126.

Figure 10:
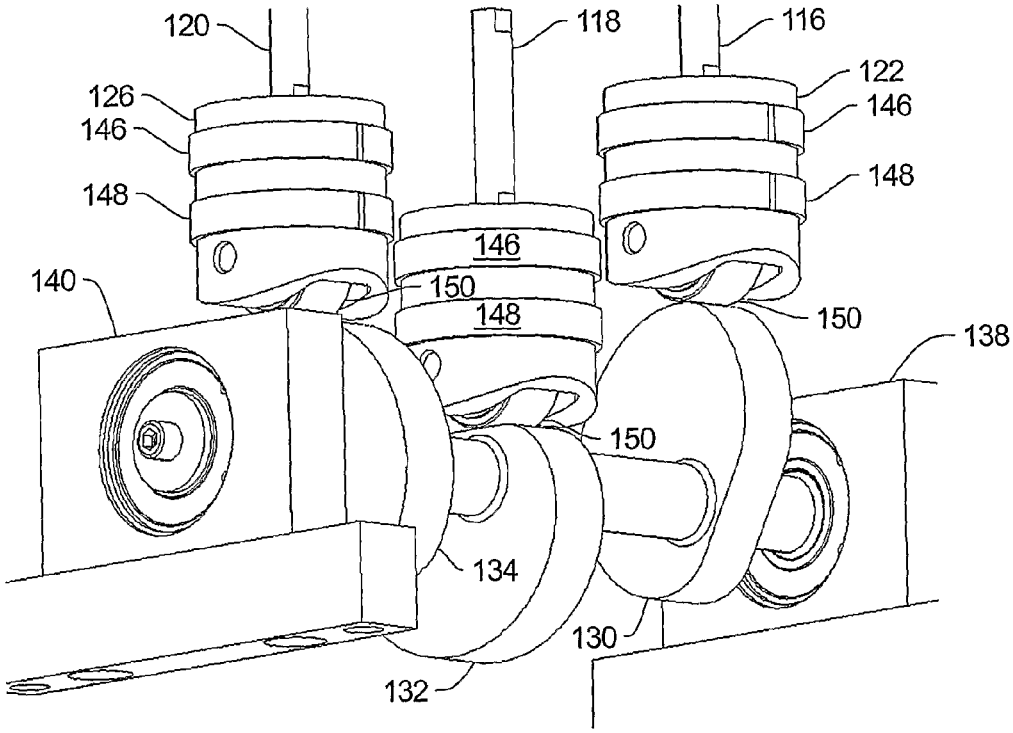
FIG. 10 is a view perspective of the cam and cam followers shown in FIG. 9.
Figure 11:
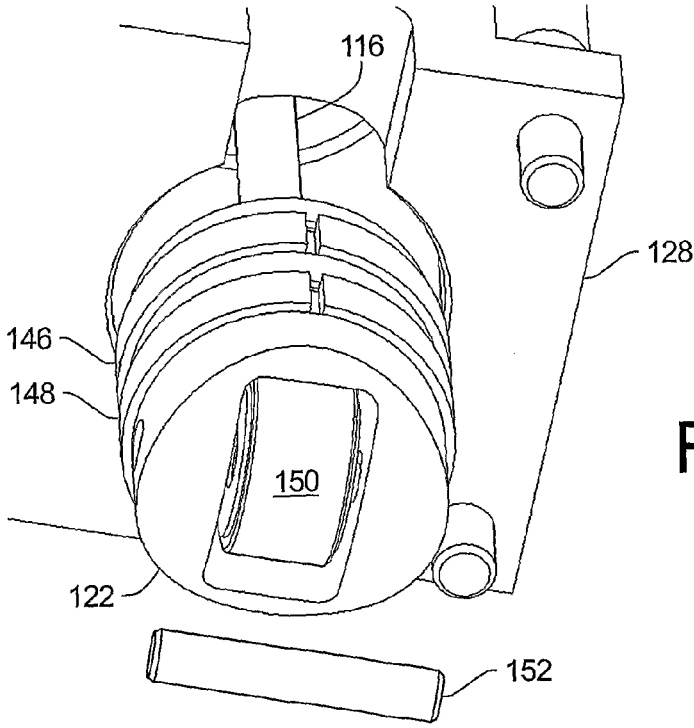
FIG. 11 is a partially exploded view of a portion of the compressor housing and one of the cam followers shown in FIG. 9.

As shown in FIGS. 9, 10 and 11 each of the cam followers 122-126 are stabilized laterally by two cam follower guide rings 146 and 148 which press against the inside bore holes of the compressor housing 128.

As best shown in FIGS. 10 and 11, the cam followers 122-126 have cam follower bearings 150 which contact the cams 130-134. The cam follower bearings 150 are held in place by pins 152.

Figure 12:
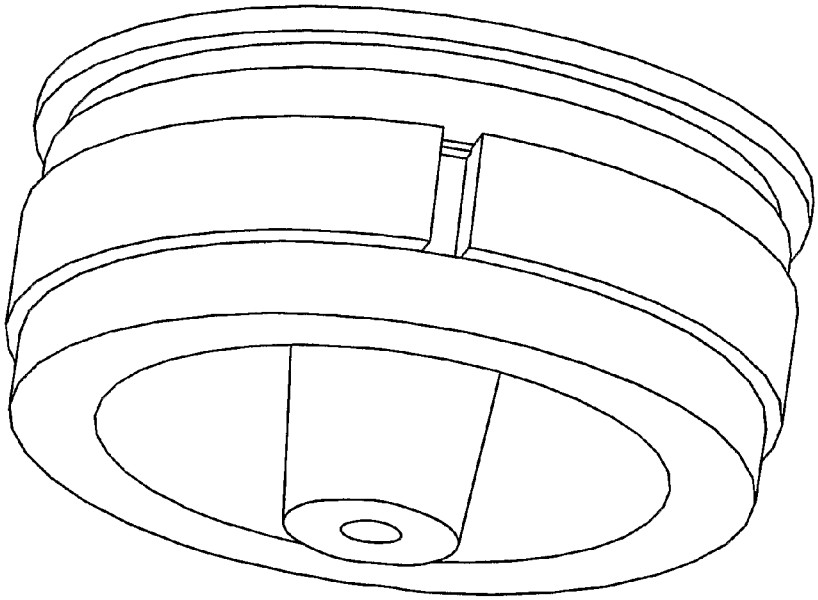
FIG. 12 is a perspective view of one of the pistons shown in FIG. 9.

FIG. 12 shows an enlarged view of the piston 108. The piston 108 and the other two pistons 104 and 106 have piston guide rings 154 to prevent laterally motion of the pistons inside the cylinders. The pistons 108-112 also have piston seals 156.

Figure 13:
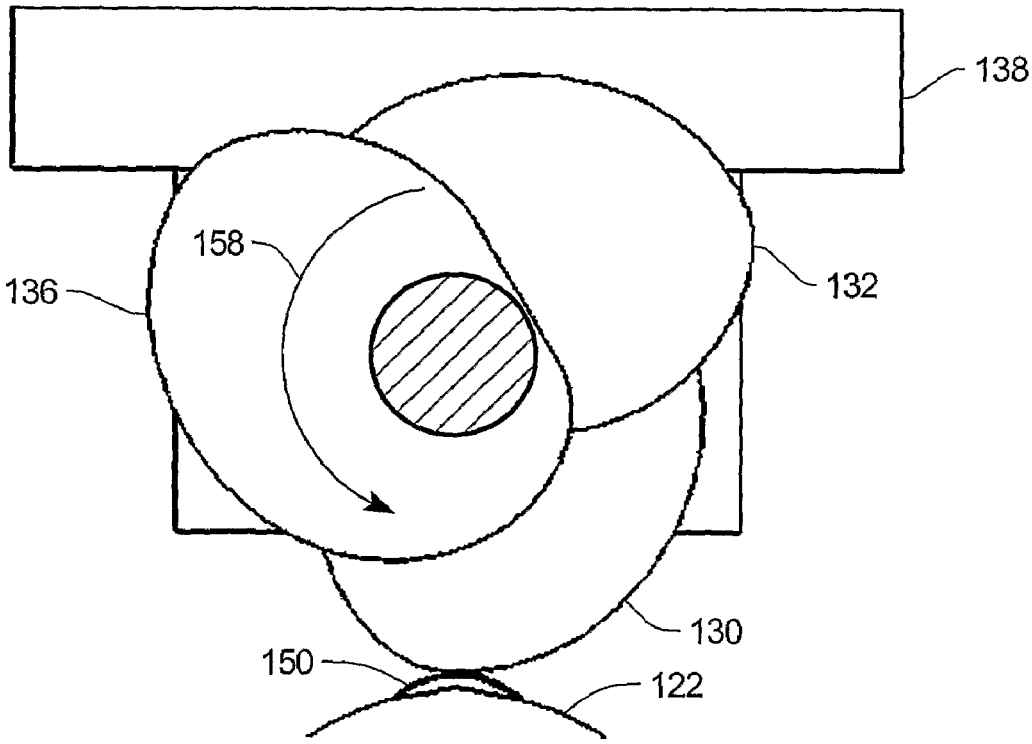
FIG. 13 is an end cross sectional view of the cam shaft shown in FIG. 9. It will be appreciated that for purposes of clarity and where deemed appropriate, reference numerals have been repeated in the figures to indicate corresponding features, and that the various elements in the drawings have not necessarily been drawn to scale in order to better show the features of the invention.

In the embodiment shown in FIG. 8 the three cams 130-134 are the same size and shape and are oriented on the axle of the cam shaft at 120° offsets as shown in FIG. 13. The three cams 130-134 rotate in the direction indicated by the arrow 158.

The individual shapes and offsets of the cams 130-134, and the relative diameters of the cylinders 104 and 108 determine the magnitude of the torque variations on the motor of the motor and belt reduction assembly 142. Those skilled in the art will appreciate that if the torque variations are minimized a lower torque motor can be used with the compressor than if the torque variations are greater.

These designs have several advantages over prior art. First, the cams can be shaped in such a way to dedicate more rotary motion into piston extension than piston retraction. In both embodiments approximately 240 degrees of input rotation is used to extend the pistons, and 120 degrees to retract the pistons. Since it takes more force to extend the pistons, spreading the force over a larger amount of rotary motion helps to lessen the torque requirements on the drive motor. This option is not available on crankshaft driven or nutating head compressors.

A second advantage to this design is the housing guide grooves and cam follower bearings in the first described embodiment and the guide rings in the second described embodiment that combine to restrict the cam followers to purely linear motion. With respect to the first described embodiment the inner and outer guide grooves help balance the forces acting on the cam follower. Since all non-axial forces on the cam followers are transmitted through rolling bearings, losses due to friction are minimized. In addition, the rolling contact helps reduce heat build-up, reduces the wear rate of the components, and reduces the need for lubrication.

A third advantage to this design is the long piston stroke made possible by the combination of the cam profile and the linear motion of the cam followers. In the preferred embodiment, the piston stroke is approximately 1.5 inches, three times longer than comparable crankshaft-drive compressors. The long piston stroke helps improve efficiency of the compressor by minimizing the effect of dead volume in the cylinders. It also allows the compressor to run slower, helping to reduce the compressor's operating temperatures, which extends seal life.

A fourth advantage is the adaptability of this design to meet the requirements of different applications. The same motor and drive section can be used to drive different arrangements of multiple piston compressors. In the preferred embodiment, the compressor utilizes three pistons connected in series, the first stage being approximately two inches in diameter, the second stage being approximately one inch in diameter, and the third stage being approximately one-half inch in diameter. However, the compressor could easily be adapted to utilize three pistons of the same diameter acting in parallel without needing to modify the drive section. Other options could include using anywhere from two to six pistons, acting in series or in parallel, of various sizes. Those skilled in the art will understand that at least some of these options would advantageously use a cam with a different cam profile from that shown in FIG. 6 to optimize the performance of the compressor.

The embodiments described are chosen to provide an illustration of principles of the invention and its practical application to enable thereby one of ordinary skill in the art to utilize the invention in various embodiments and with various modifications as are suited to the particular use contemplated. Therefore, the foregoing description is to be considered exemplary, rather than limiting, and the true scope of the invention is that described in the following claims.

We claim:

1. A cam driven piston compressor comprising:

a. three cams mounted on a cam shaft of a motor at an angle of 120° relative to one another and powered by said motor and adapted to rotate in parallel planes;

b. a cam follower in contact with each of said cams;

c. a piston attached to each cam follower;

d. a cylinder enclosing each piston, wherein at least two of said cylinders are of different diameter; and e. a compressor head in contact with each of said cylinders; whereby each of said cams has a shape producing substantially 240° of input rotation used to extend a respective said piston and substantially 120° of output rotation used to retract a respective said piston.

2. The cam driven piston compressor set forth in claim 1 comprising a plurality of cam followers, a plurality of pistons, and a plurality of cylinders;

a. wherein said pluralities of cam followers, pistons, and cylinders are of like number.

3. The cam driven piston compressor set forth in claim 2 wherein the number of cylinders which would compress a gas at one time is equal to or greater than the number of cylinders that would not be compressing a gas.

4. The cam driven piston compressor set forth in claim 2 wherein each of said plurality of cam followers includes a rotatable bearing that contacts each of said plurality of cams.

5. The cam driven piston compressor set forth in claim 2 further including at least one spring contacting at least one cam follower for pressing said cam follower against a corresponding one of said plurality of cams.

6. The cam driven piston compressor set forth in claim 5 wherein said at least one spring comprises three springs.

7. The cam driven piston compressor set forth in claim 1 wherein said plurality of cams each has the same size and shape.

* * * * *